US005411269A

United States Patent [19]

Thomas

[11] Patent Number: 5,411,269

[45] Date of Patent: May 2, 1995

[54] ELECTRONIC FLUID SENSING ACTUATING TARGET APPARATUS

[76] Inventor: Keith Thomas, 4835 Hwy. 52, Loretto, Ky. 40037

[21] Appl. No.: 121,732

[22] Filed: Sep. 15, 1993

[51] Int. Cl.[6] ..... A63F 9/02; A63F 9/24

[52] U.S. Cl. ..... 273/349

[58] Field of Search ..... 273/349, 85 H, 313, 273/317, 348, 371, 374, 375, 377, 455, 457; 446/473, 267

[56] References Cited

U.S. PATENT DOCUMENTS

| | | | |
|---|---|---|---|
| 3,336,030 | 8/1967 | Martell et al. | 275/349 |
| 3,434,717 | 3/1969 | Schwartz | 273/349 |
| 3,572,712 | 3/1971 | Vick | 273/349 |
| 4,502,044 | 2/1985 | Farris et al. | 340/604 |
| 4,743,030 | 5/1988 | Auer et al. | 273/101 |
| 5,011,161 | 4/1991 | Galphin | 273/349 |
| 5,086,291 | 2/1992 | Schwab, Jr. | 340/604 |

*Primary Examiner*—Jessica J. Harrison
*Attorney, Agent, or Firm*—Charles M. Hogan

[57] ABSTRACT

Water-gun Target Game and Apparatus in which a direct-current electrical water-presence detector, supported by or worn on an outer garment, is the bull's-eye. A hit by the water jet initiates action by a direct electrical effect, such as a resistance change, ordering responses by switching, sound or visual signaling, and scoring devices. A water-level sensor option initiates a steady signal after a succession of hits or a strong continuous hit. A single shunt option can be used to prevent false triggering. An absorption option disposes of received water, allowing repetitious operation. A tank for the water level sensor has a discharge stopper, which when removed, opens a power source circuit and inhibits any response. The object of the game is to project the jet stream of the water gun on to the target, making one or repetitious hits on the apparatus-bearer's bull's-eye. Counter-circuitry provides digital visual scoring.

15 Claims, 18 Drawing Sheets

ELECTRONIC FLUID SENSING ACTUATING TARGET APPARATUS

BACKGROUND

1. Field of Invention

This invention is a novel direct current Electronic Fluid Sensing Actuating Target Apparatus designed to respond upon penetration of fluid to sensing electrodes, thereby actuating noise-making, lighting, digital counting, electromechanical, and any electronic exciter response desired.

2. Description of Prior Art

By nature man is an aggressive being. This competitive nature is reflected in history's vast catalog of combative sports and other games popularly played over the years. Such combative games provide an entertaining outlet for man's more beastly passions. Warrior/hero role playing in competition allows healthy release of hostile and aggressive tendencies.

Squirt guns, water pistols and water targets have long been implements of such entertainment. Some of today's squirt guns shoot water up to 50 feet, others only inches. When children use squirt guns without accessories, little interaction occurs, outside of mutual soaking. Likewise, typical water targets are simple, unchallenging instruments of play. Such art offers some diversion, and promotes interaction among children involved in water toy games. However, the present art lacks an apparatus for making such games more fun, more challenging, safer and friendlier.

At carnivals, squirt guns using water under pressure shoot at targets, actuating external devices. Targets of this type plug into alternating current receptacles and employ mechanically actuated switching components requiring high water pressure, limiting the compactness, mobility and general use of these arrangements.

A water gun target U.S. Pat. No. 3,434,717 by Arthur Schwartz of Annapolis, Md., issued Mar. 25, 1969, utilizes foamed plastic material for creating a distinct "splat" sound when impinged by a water beam. Additionally, the target portion includes a plurality of apertures providing moveable members pivotally mounted for easy rotation upon the impingement of a water beam, thereby causing electrical contact to lamps connected therein. No means is provided for electronic noise-making, digital counting, electromechanical, or other exciting responses. Compactness and mobility is also compromised.

A water gun and target combat game by Robert T. Auer, East Stroudsbourg, Pa. and Richard L. Keats, Sands Point, N.Y., U.S. Pat. No. 4,743,030 issued May 10, 1988, utilizes a target constituted by a plaque or other hit indicator covered by a mask that conceals the indicator. The hit indicator is rendered readable only when the mask is made wet and transparent by a water beam impinging thereon. With this arrangement the instantaneous impingement of a second or third water beam will not register, nor does the target elicit high levels of challenge and excitement, like that obtained from the present invention. The present invention allows such registration from simultaneous water beams.

Current products fail to provide a direct current apparatus for direct electronic sensing and response to the water stream emanating from water ejecting toys. Such an apparatus, if simple enough, could be supported by and worn on various types of garments, offering exciting electronic responses. This may include noise generating, digital counting, lighting, electromechanical manipulation and any electronic response desired in reaction to the impingement of a water beam. Such target equipment would offer a degree of protection from soaking streams. More importantly, the high levels of excitement created by such a target apparatus cause the target apparatus to be the focus of water streams, promoting friendlier and safer interactive play.

Products currently available in the art fail to offer an apparatus to perform as:

- An electronic fluid sensing actuating target apparatus responding upon penetration of fluid to sensing electrodes, thereby actuating noise, lighting, digital counting, electromechanical and any exciter response desired.
- A lightweight, mobile, inexpensive, direct current electronic water target apparatus of simple structure and simple operation.
- An electronic water target apparatus for easy assembly into helmets, belts, vests, shields, wrist, arm, leg bands, moving targets, stationary targets, or structures.
- An electronic water target apparatus which responds to various intensities of drenching.
- An electronic water target apparatus for electronically measuring and responding to preset fluid flow accumulation time or preset volume of accumulated fluid.
- A safe, electronic fluid sensing actuating target apparatus to serve as the focus of water streams from squirt guns and other liquid ejection toys.

OBJECTS AND ADVANTAGES

Figure 1A:
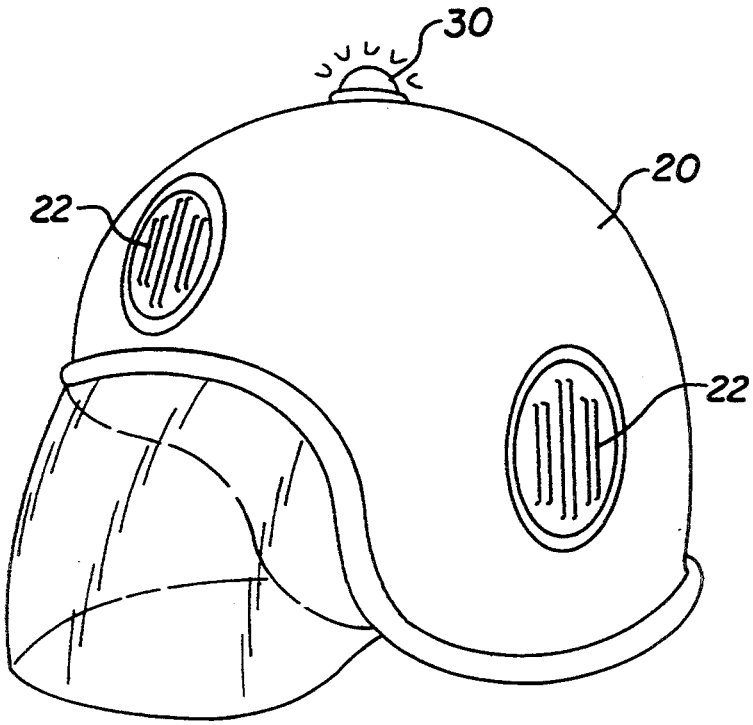
FIG. 1A and FIG. 1B are, respectively, frontal perspective and rear views of an embodiment of my target apparatus incorporating a water proof helmet, including an assembly of exciter (ie. electrical signal) devices.
Figure 1B:
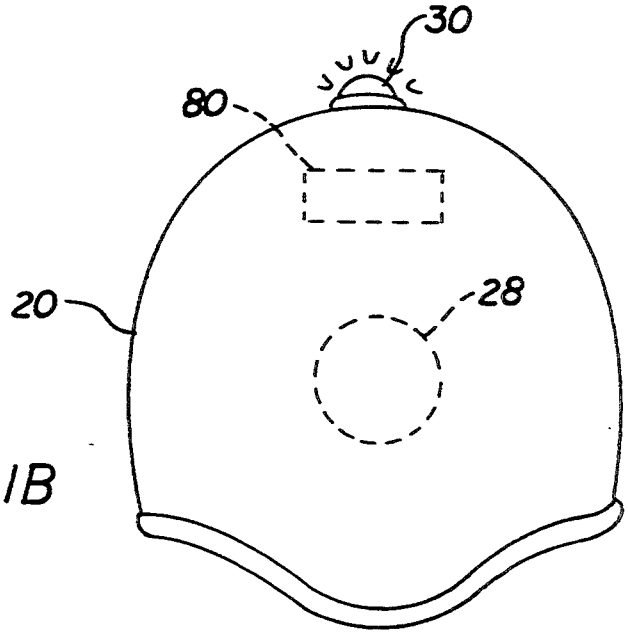
Figure 2A:
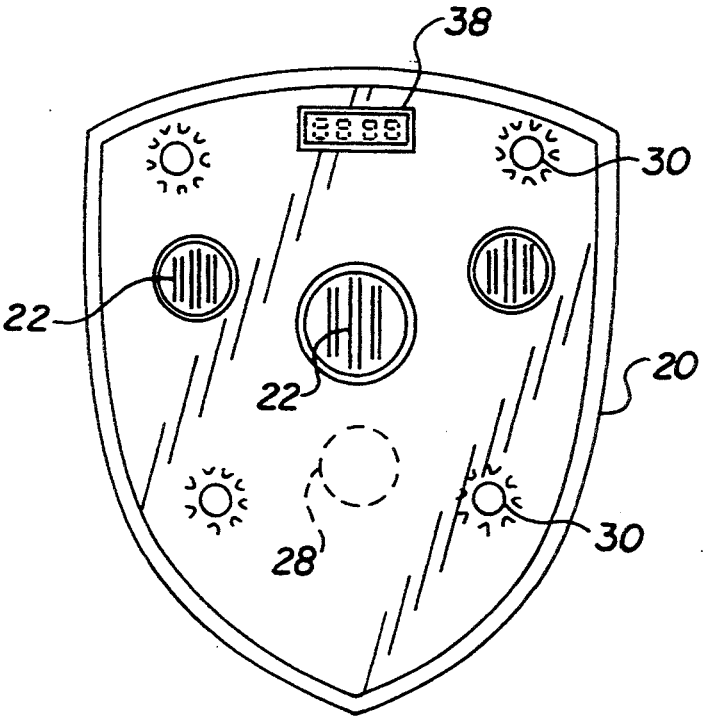
FIG. 2A and FIG. 2B are respectively front and rear views of another embodiment of my target apparatus incorporating a shield, including an assembly of exciter (ie. electrical signal) devices.
Figure 2B:
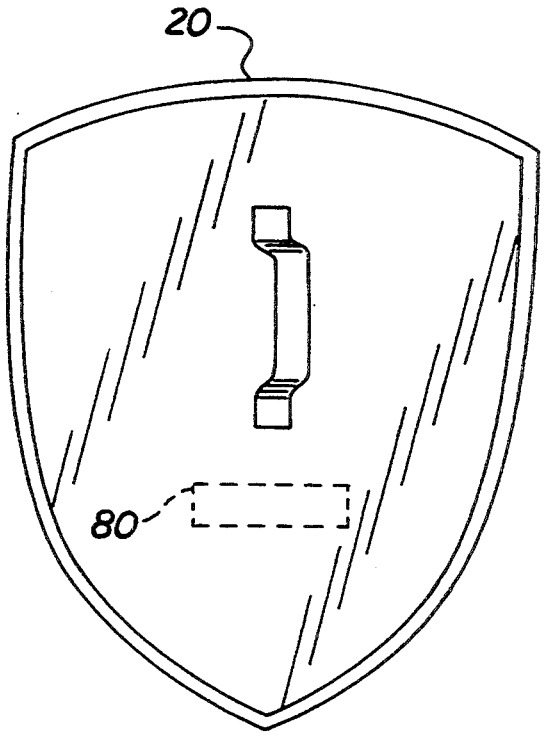

The present invention conceives a new jet-water game and water target apparatus that electronically responds to the flow of liquid.

Such a target apparatus, combined with appropriate waterproof embodiment gear, offers a degree of protection for the user. Fluid streams ejected by squirt guns and other water squirting toys are thus aimed at the apparatus instead of the opponent's clothing. Such an apparatus, assembled into various water target embodiments, results in friendlier, more orderly and safe interaction where fluid ejection toys are involved.

It is therefore an object of the present invention to provide a novel electronic water target apparatus that responds upon penetration of fluid to sensing electrodes, thereby actuating noise-making, lighting, digital counting, electromechanical, and any electronic response desired.

Another object of the present invention is to provide a lightweight, mobile, inexpensive, direct current electronic water target apparatus of simple construction and operation, for easy assembly into helmets, belts, vests, shields, wrist, arm, leg bands, moving targets, stationary embodiment gear or structures and the like.

Another object of the present invention is to provide an electronic water target apparatus that responds to various intensities of drenching.

Another object of the present invention is to provide an electronic water target apparatus that electronically responds to preset accumulated fluid response time or preset volume of accumulated fluid.

Another object of this invention is to provide a means of channelling residual water away from sensor electrodes after penetration of liquid, thereby avoiding false triggering of apparatus.

Drawing Reference Numerals

| | | | |
|---|---|---|---|
| 18a–189. | Electronic Fluid Sensing Actuating Target Apparatus Circuits | 52 | Bus Wire |
| | | 54 | Bus Wire |
| 19 | Channeling Grid | 56 | Bus Wire |
| 20 | Embodiment Gear | 58 | Reset Switch |
| 21 | Zener Diode | 60 | Recessed Lip |
| 22 | Fluid Sensing Electrodes | 61 | Optoelectronic Fluid Sensor |
| 23 | Spongy Material | 62 | Aperture |
| 24 | Solid State Relay | 63 | Light Emitting Diode |
| 25 | Buzzer | 64 | Collection Tube |
| 26 | Noise Generating Chip | 65 | Phototransistor |
| 27 | Basic Signal Generator Chip | 66 | Splash Cover |
| 28 | Speaker | 67 | Optoelectronic Fluid Sensor |
| 29 | Common Amplifier Chip | 68 | Splash Cover Hole |
| 30 | Lamp | 70A | Sensor Array Housing |
| 31 | RMS to DC Converter Chip | 70B | Sensor Array Housing |
| 32 | Common Timing Chip | 71A | Relay |
| 33A | Resistor | 71B | Relay |
| 33B | Resistor | 72A | Actuation Bar |
| 33C | Resistor | 72B | Actuation Bar |
| 34 | Decade Counting Chip | 73 | Central Common Axle |
| 35A | Capacitor | 74A | Drive Motor |
| 35B | Capacitor | 74B | Drive Motor |
| 35C | Capacitor | 75 | Transistor |
| 36 | BCD to Decimal Decoder Chip | 76 | Microswitch |
| 38 | 7-Segment Light Emitting Diode | 77 | Transistor |
| 40 | Saturation Chamber | 78 | Right Fluid Sensing Electrode |
| 42 | Saturation Sensor | 79 | Left Fluid Sensing Electrode |
| 43 | Connecting Harness | 80 | EFSATA Assembly |
| 44 | Power Supply | 91 | Conducting Bar |
| 45 | Fluid Release Cap | 93 | Metal Pivoting Electrodes |
| 47 | Bus Wire | 95 | Stand Off Post |
| 48 | Bus Wire | 97 | Weight Bands |
| 49 | Power Switch | 99 | Conducting Bus Strip |
| 50 | Electrode Housing | | |

Another object of the present invention is to create electronic water target games and devices offering high levels of excitement, providing advantages over the current or prior art.

Another object of the present invention is to provide an exciting, safe electronic water target apparatus to serve as the focus of fluid streams from squirt guns and other liquid ejection toys.

Additionally, an object of the invention is to provide a means for creating a friendlier atmosphere, leading to more orderly, safer interaction where water ejection toys are involved.

The above and other objects become apparent from the preceding and following disclosures:

DESCRIPTION

The Electronic Fluid Sensing Actuating Target Apparatus in the drawings is designed for use with squirt guns, water pistols and other water ejecting toys. The target apparatus can be applied to create hundreds of water toy accessories, enhancing the entertainment value of such toys, and adding an element of safety to water ejection games. Additionally, the apparatus introduces a new dimension of imaginative play, since target points are rendered specific, with tangible signals for point scoring and other responses for game results.

When liquid squirted from any water ejecting device penetrates liquid flow sensing electrodes of target zone, electronic response occurs. This response is actuation of exciter devices. Exciter device actuation ceases when liquid flow penetration to sensing electrodes ceases. The electronic exciter response may be noise generating, digital counting, lighting, electromechanical and any electronic exciter response desired.

Figure 9A:
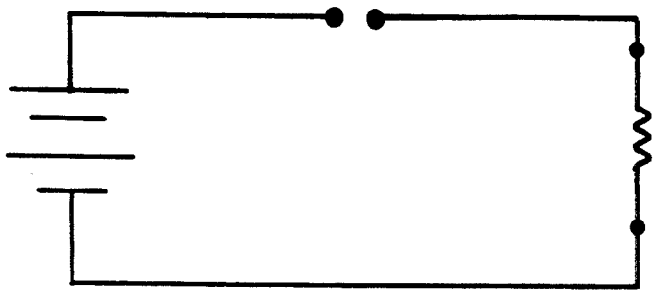
FIG. 9A shows two biased metal electrodes and a power supply connected to a load.

In FIG. 9A the negative of a direct current power supply connects directly to one input of a load. Positive of the power supply connects to a first metal electrode. A closely situated second metal electrode connects to the remaining input of the load. The power supply is numbered 44 in FIG. 10A. In that figure the electrodes numbered 22 comprise a pair of electron groups. In this specification an electrode group which is interconnected is sometimes called an electrode.

Figure 9B:
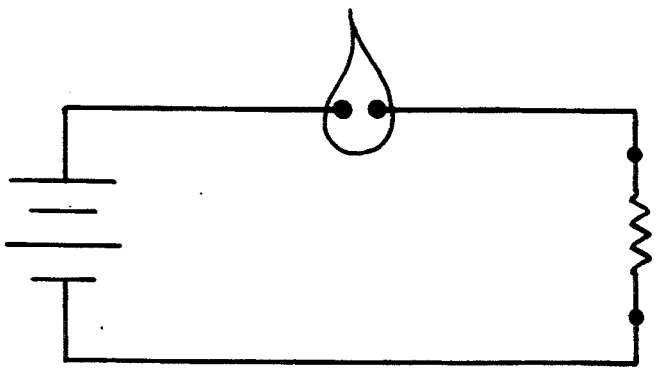
FIG. 9B shows the same biased metal electrodes impinged by fluid.
Figure 9C:
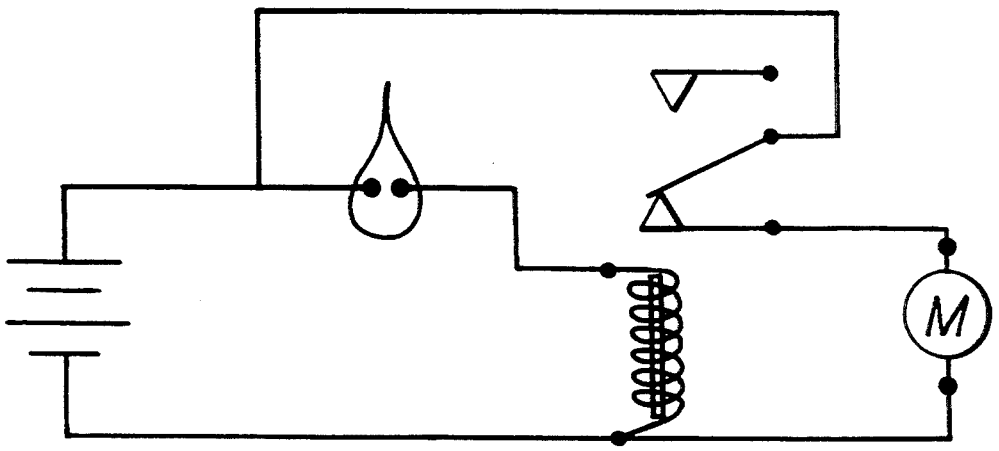
FIG. 9C shows biased metal electrodes impinged by fluid with a relay as the load which activates the motor connected to the relay output.

In FIG. 9B an impinging water beam across the two electrodes causes the electrodes to short circuit, resulting in current flow between the two electrodes. However, since water is a poor electrical conductor, current flow created by the short circuit is minimal. If the load were a motor or other high current device, no activation would occur via the short circuit of liquid upon the electrodes. For a load requiring minimal activation current such as a solid state relay as shown by 24 in FIG. 10A, activation would occur because of circuit impedance drop when the electrodes are short circuited by water. The term "impedance" includes the resistance parameter. Thus liquid penetration across the electrodes is here utilized to operate relay 24. The power source 44 is switched by the output of relay 24 onto the bus-wire circuit 47, 48, which supplies power to the signaling devices, such a noise generator 26, speaker 28, lamps 30 and the digital scoring system including elements 34 and 36. A load is shown, in principle, by the symbol M in FIG. 9C.

The preferred fluid sensing sensing means is the resistive type (FIG. 10A) whereby biased metal electrodes 22 are short circuited upon the impingement of a water beam activating a switching relay 24.

Figure 8:
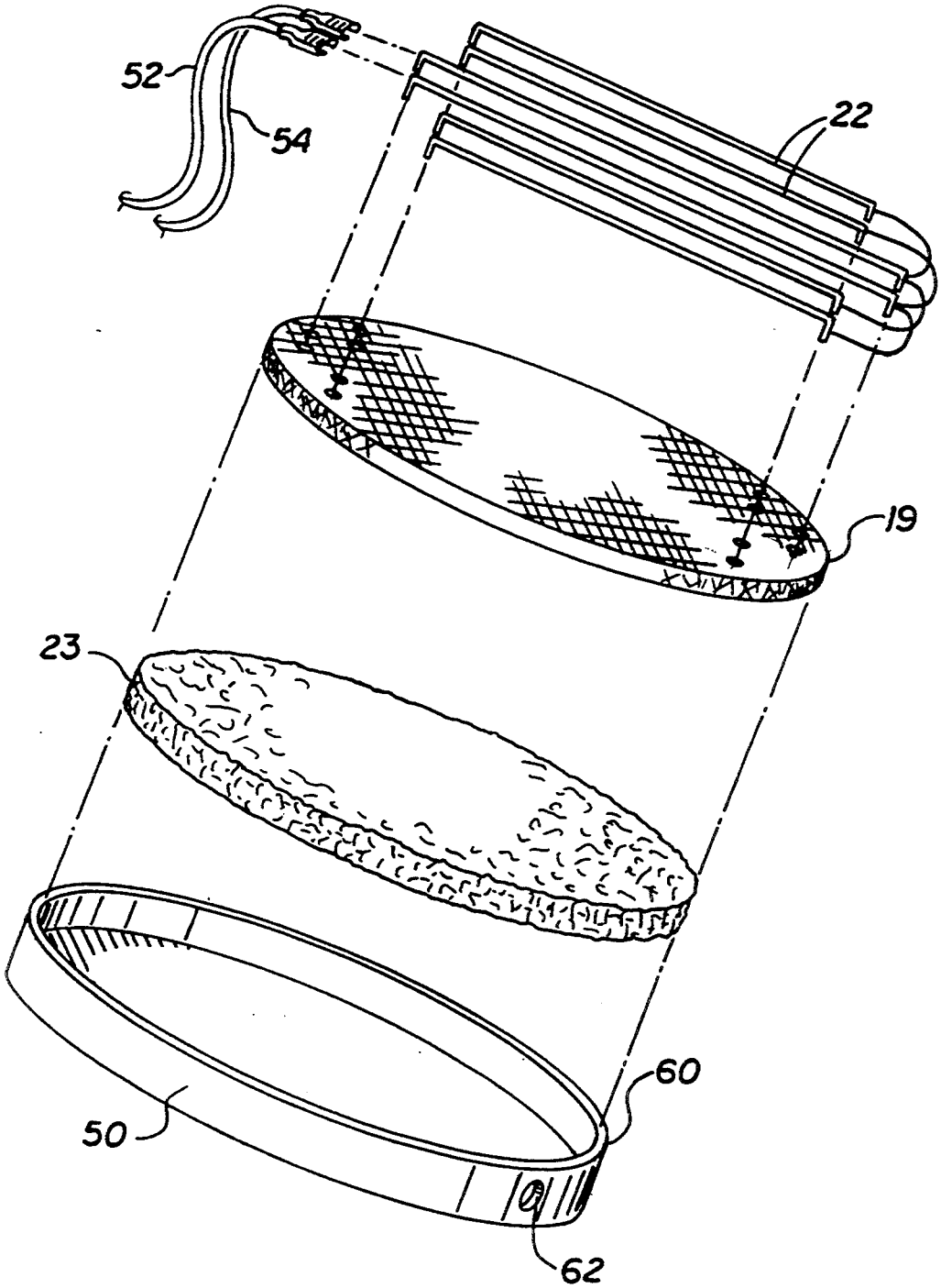
FIG. 8 shows a plastic grid and sponge for channeling residual water away from electrodes.

As shown in the Figures, liquid sensing electrodes are mounted in any suitable sheathing or housing, exposing the sensing electrodes. FIG. 8 shows the addition of a channelling means to enhance removal of residual water from sensor electrodes. A plastic grid 19 making contact with and set behind the electrodes channels liquid away from electrodes. To assist this action a water saturable means such as a sponge 23 placed directly behind and contacting the plastic grid provides a means of enhancing the action of the grid to absorb liquid away from the electrodes. This avoids false triggering that could be caused by adherence of residual liquid to electrodes. Remaining connecting circuitry may be contained in any suitable waterproof housing arrangement.

Figure 10A:
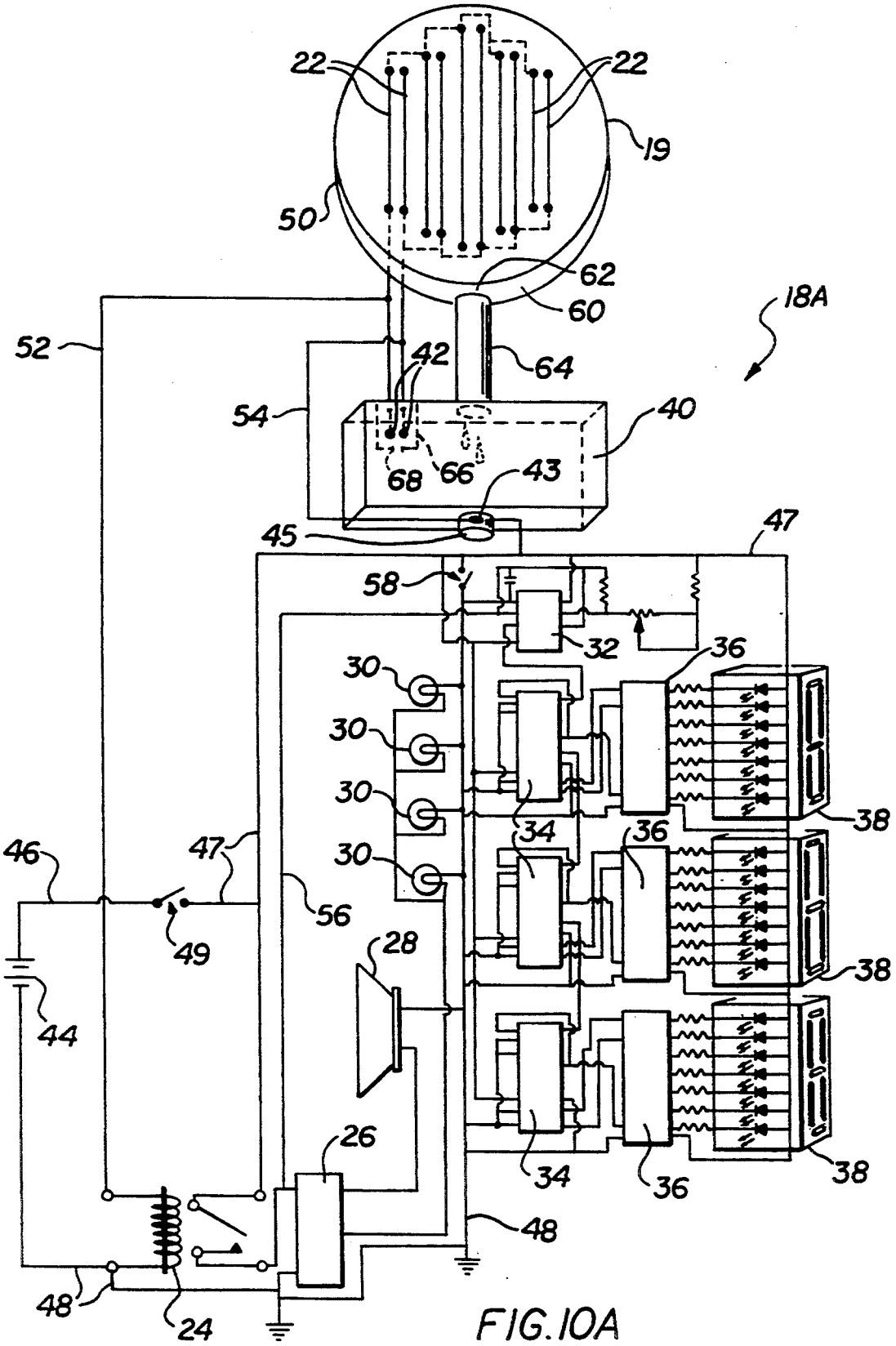
FIG. 10A depicts schematic representation of the Electronic Fluid Sensing Actuating Target Apparatus (EFSATA) showing the preferred fluid sensing means utilizing noise generating exciter circuitry.

A conventional power source such as a 9-volt battery 44 biases the detector-battery-relay-input circuit, as shown in FIG. 10A. Electrodes 22 of any metal that conducts electricity are placed in close proximity, in sets of two, about the face of the target housing. When liquid penetrates any set of electrodes, the electrodes are electrically biased to create a short circuit which generates a transient, closing the relay and causing the relay output to complete the power circuit for the signaling system.

The voltage and current flow created by the short circuit by the impingement of a water beam across biased metal electrodes is minimal. Thus the switching component should be a low voltage, low current type. A solid state relay is shown in the present invention. However, comparable components will suffice. Thereby enough voltage and current is generated, upon impingement of a water beam, to activate a switching relay. Whereupon higher voltage and current required for signal and scoring devices is simultaneously switched directly from the power source. This is achieved by connecting the power circuit through outputs of the relay.

Negative of power source connects directly to the ground input of switching relay. Positive of power source connects to each fight electrode in every set of two electrodes. The left electrode in every set connects to remaining input of switching relay via line 52 (FIG. 10A). Liquid flow penetrating any set of electrodes creates a short circuit between the electrodes. Since the left electrode is connected to the switching relay, and the fight electrode to positive of power supply, current flows to activate the solid state switching relay(s), upon short circuit of electrodes. This switching relay has signaling and scoring devices connected to its output. Thereby, upon switching relay activation, exciter devices including noise generating, digital counting, lighting, etc., housed within chosen embodiment gear and connected therein, are actuated. Wires 47 and 48 are, respectively, the positive and grounded main wires of the power supply system. Wire 47 reaches the right hand detector electrode via the wire 54 line. All of the lamps 30, noise generator 26, speaker 28, and the scoring system including units 34 and 36 are supplied with electrical energy via wires 47 and 48, assuming that relay 24 and switch 49 are closed.

The preferred fluid sensing means just described is the resistive type, whereby an impinging water beam short circuits metal electrodes, activating a relay, thereby actuating exciter devices. It should be noted that many fluid sensing options exist. Fluid sensors utilizing resistive reactive, capacitive reactive, optoelectronic, mechanical, and any means capable of generating a signal for activating a relay or other switching means can be used.

Figure 11:
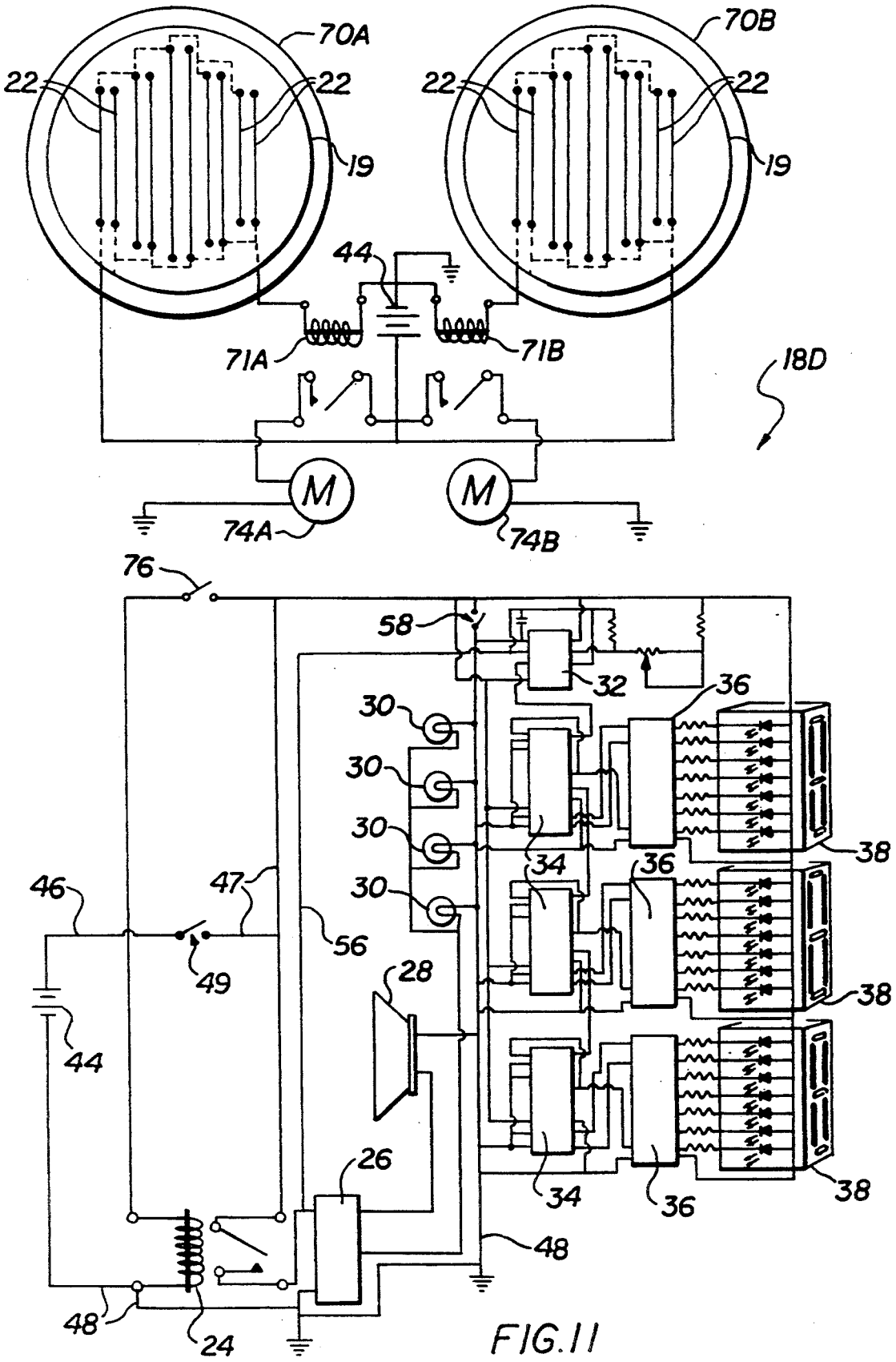
FIG. 11 depicts schematic representation of Electronic Fluid Sensing Actuating Target Apparatus utilizing electromechanical exciter components.

In FIGS. 10A and 11, metal fluid sensors are employed. Liquid penetration of fluid sensors creates a short circuit, actuating exciter components via switching means assembled therein.

Figure 12A:
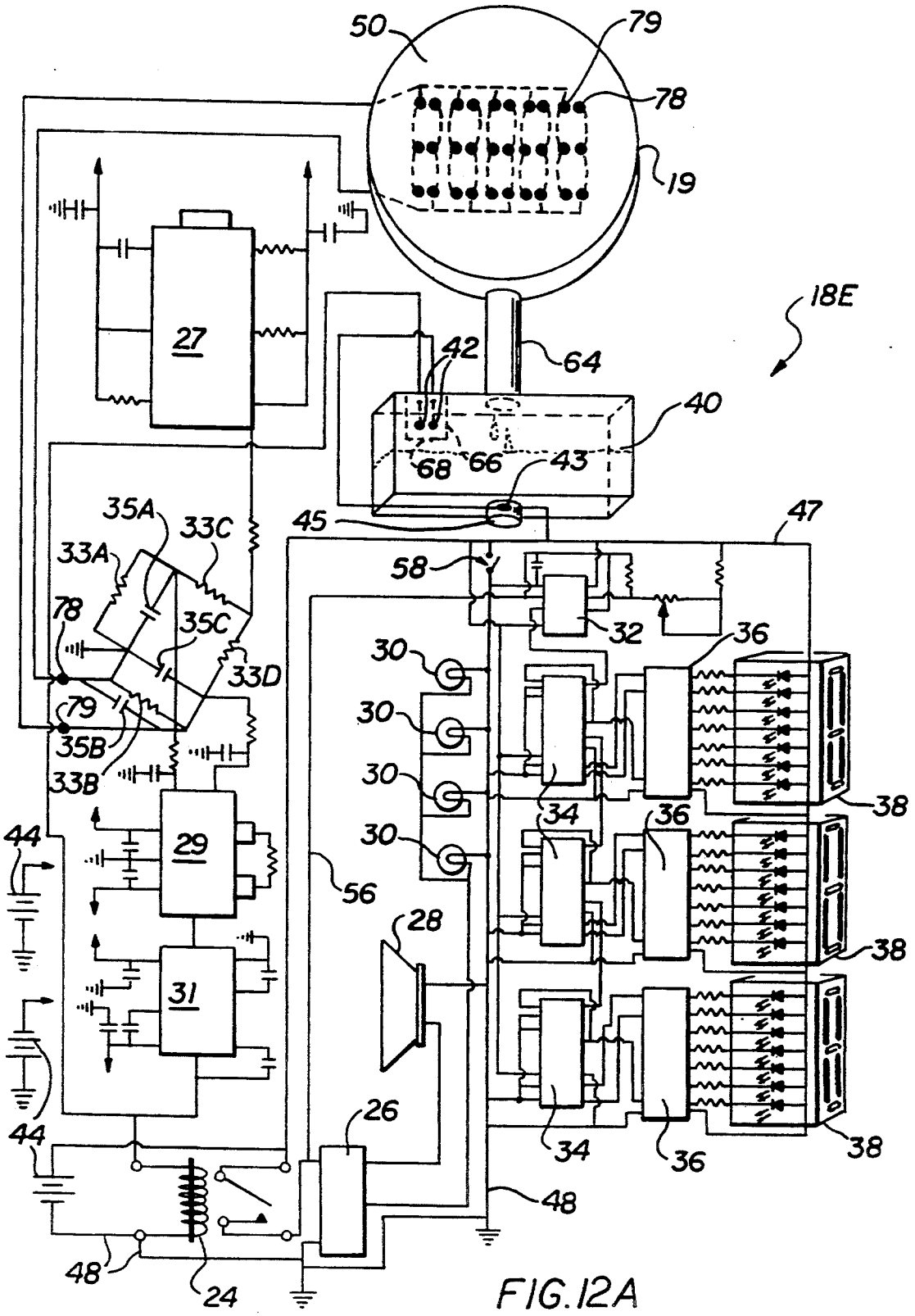
FIG. 12A depicts schematic representation of Electronic Fluid Sensing Actuating Target Apparatus utilizing capacitive reactive fluid sensing circuitry.
Figure 12B:
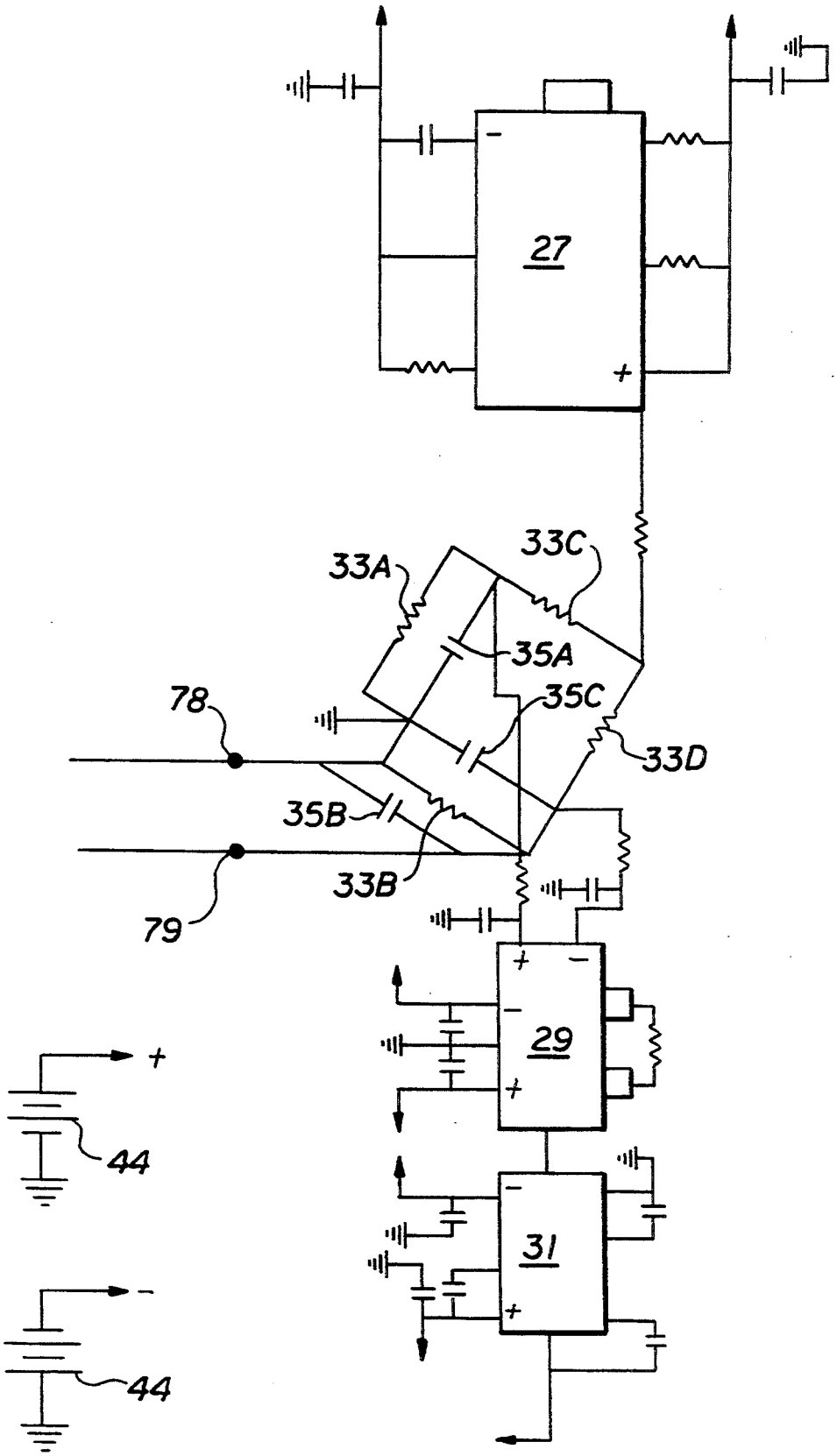
FIG. 12B shows schematic enlargement of a portion of the circuitry for the capacitive reactive fluid sensing means.
Figure 13A:
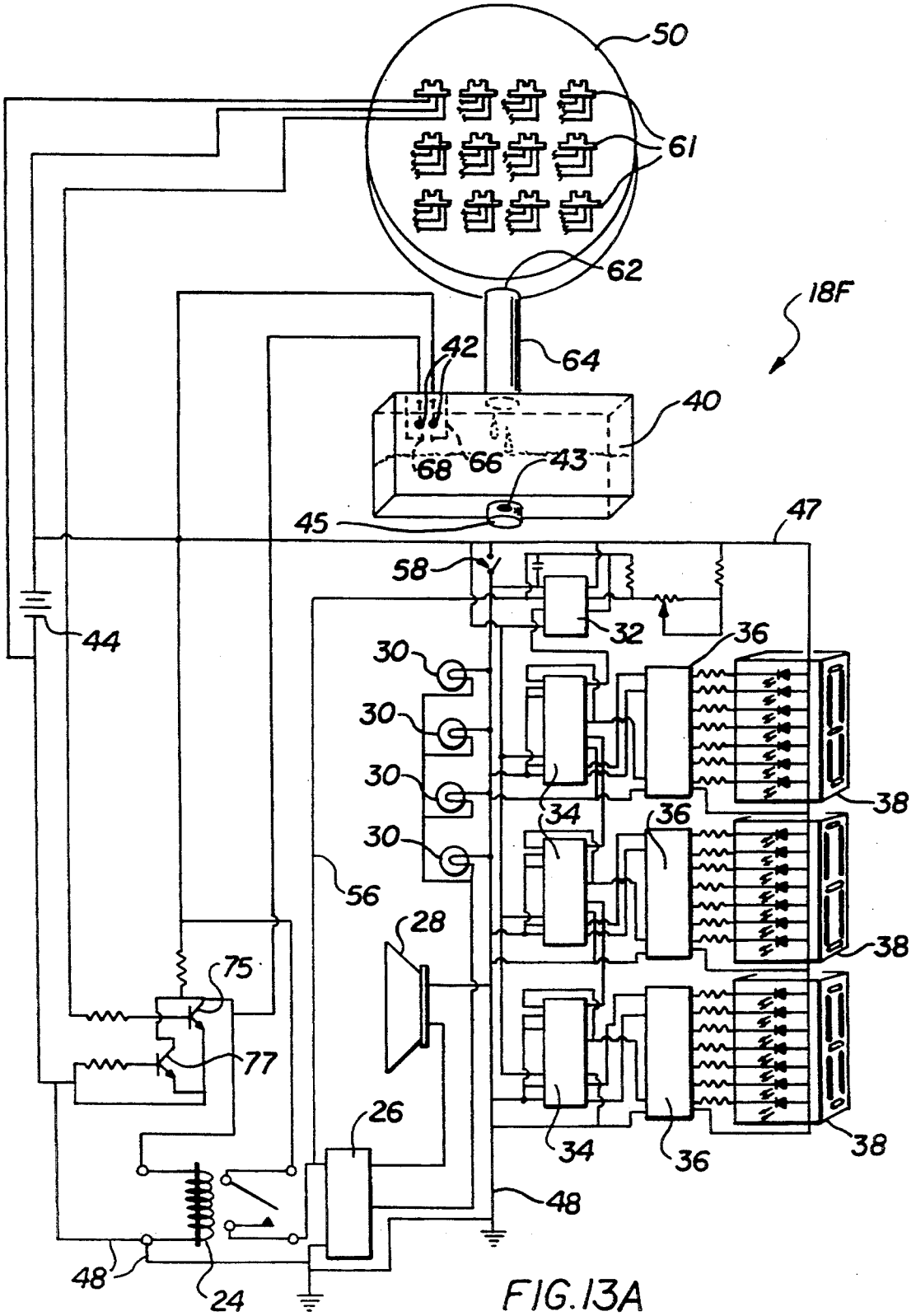
FIG. 13A shows schematic of Electronic Fluid Sensing Actuating Target Apparatus utilizing optoelectronic fluid sensing means.
Figures 14A, 14B:
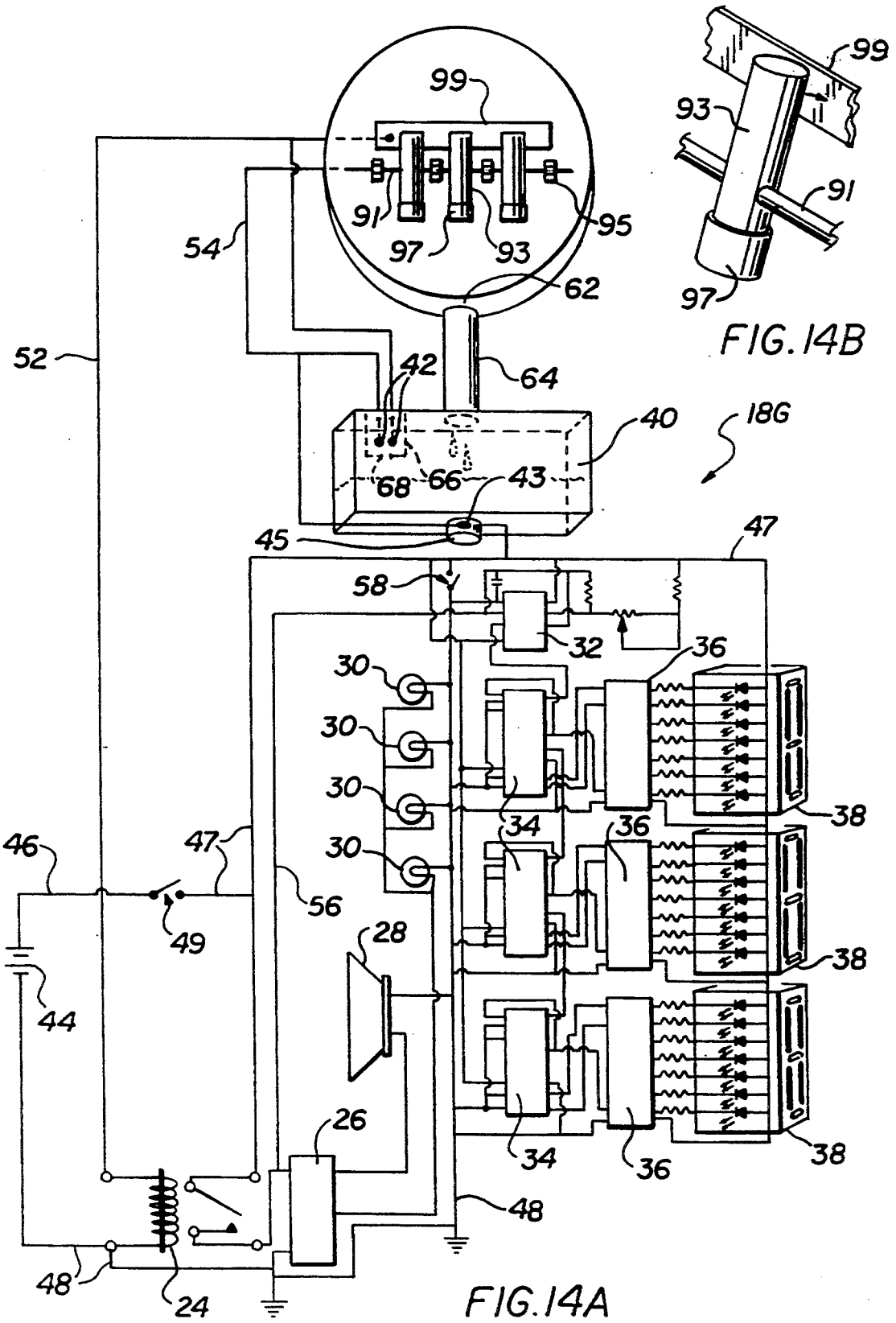
FIG. 14A depicts Electronic Fluid Sensing Actuating Target Apparatus utilizing mechanically actuated fluid sensing means.
FIG. 14B illustrates side view of pivoting electrode used on mechanically actuated target apparatus.

FIGS. 12A, 13A and 14A show fluid sensing means other than those in FIG. 10A and 11. In FIGS. 12A and 12B metal fluid sensors again are employed. However, capacitive reactive fluid flow sensing circuitry is utilized. A signal generator 27 (FIG. 12A) establishes a reference frequency upon each fight fluid sensor electrode. Penetration of fluid to sensors results in capacitive change between right reference electrodes and left input electrodes, causing reference frequency generated at right fluid sensor electrode to change. This frequency change generates a switching signal, thereby activating a switching means for actuating exciter devices assembled therein.

In FIG. 13A an optoelectronic fluid sensing means is employed. Fluid sensors containing a light emitting diode and phototransistor are used. When fluid blocks the light path of the light emitting diode, the photo transistor generates a triggering signal for activating the switching means for actuating exciter components of the chosen embodiment.

In FIG. 14A, mechanical fluid sensing means is employed. Electrodes with positive bias that pivot upon penetration of fluid are made to contact conducting bus. When contact is made, switching means is activated, actuating exciter components assembled therein.

By arranging different combinations of fluid sensors, switching means and exciter circuitry components, many target configurations are possible, utilizing cause and effect targeting action responses. For example, FIGS. 3B and 10A illustrate the addition of a saturation chamber 40 which collects liquid via a channel 62 (FIG. 8) and an aperture at base of housing lip. This special sensor housing accomodates a cause and effect targeting response that increases game options by recognizing preset volume of fluid. Liquid falls from sensing electrodes 42 and accumulates in chamber 40. While the action of electrodes 22 is brief, that of electrodes 42 is of long duration, keeping the relay 24 closed and the signal devices activated, once the chamber 40 is filled to capacity with water.

As seen in FIG. 10A, the saturation chamber arrangement provides a fluid release cap 43 part of a plug and socket device 45. One side of the power source is routed through the cap via a bus wire and connector. When cap is released to empty liquid from chamber, deactuation of exciter devices, and demobilization of electronics occur due to disconnection of bus wire and connector. Cap may be retained by opponent, effectively neutralizing his adversary's target. Neutralized target still has a degree of protection from liquid stream, provided target embodiment is waterproof. Since the target apparatus becomes the focus of the liquid stream, safer and friendlier interaction results.

Another type of configuration that may be achieved is a less sensitive target which responds only when heavily drenched by water. In FIG. 10C a zener diode 21 has been installed between the target sensor and input of the relay. Therefore a large amount of fluid must drench the fluid sensors to overcome the reverse bias of the zener diode, whereupon the diode begins conducting, sending a triggering signal to the switching relay, which actuates the exciter devices. A resistor or comparable component may be utilized in place of the zener diode for a similar desensitizing effect.

DESCRIPTION OF MAIN EMBODIMENT

Referring now to the drawings and initially to FIGS. 1A through 7, there is illustrated an Electronic Fluid Sensing Actuating Target Apparatus (EFSATA), assembled into various embodiment gear 20. The electronic target apparatus is designed to create such a level of challenge and excitement that it becomes the focus of water streams from squirt guns and other liquid ejection toys, making water toy games more friendly and safer. Embodiment gear 20 of each target apparatus is designed to provide waterproof protection for operating circuitry and may provide waterproof protection for users as well.

Suitable embodiment gear 20 in FIGS. 1A–7 allows for attachment of exposed fluid sensing electrodes and provides waterproof protection for connecting operating circuitry. Target apparatus in FIGS. 1A–7 comprises various assemblies. Fluid sensing electrodes of water-presence detector 22 are the focal point of operating circuitry. Liquid flow penetrating these electrodes 22 creates a short circuit, causing exciter circuit responses. These electrodes may be mounted in any suitable housing or sheathing for exposure. Housing for connecting operating circuitry must be waterproof.

Referring to FIG. 8, a channelling means is added to enhance removal of residual water from sensor electrodes 22. A plastic grid 19 making contact with and set behind the electrodes 22 channels liquid away from electrodes 22. A water saturable means such as a sponge 23 placed directly behind and contacting plastic grid 19 provides a means of enhancing the action of the grid 19 to carry liquid away from the electrodes 22. This avoids false triggering that could be caused by adherence of residual liquid to electrodes 22.

In FIG. 10A, in addition to fluid sensors 22, important circuitry for operation of EFSATA 18 is the switching circuitry, which contains a solid state relay 24. Additionally, the exciter circuitry represents the exciter response reaction components. These include a common noise generating integrated chip 26 which drives speaker 28 and lamps 30. Relay 24 drives chip 26 and timing chip 32. Timing chip 32 drives decade counters 34, which drive typical binary coded decimal to 7-segment decoder counting chip 36, for driving 7-segment light emitting diodes 38. Light emitting diodes 38 may be mounted suitably for viewing, if waterproof protection is provided.

In FIG. 10A an additional means for reactive response, a saturation chamber 40 is shown. Once liquid has accumulated to saturate chamber 40, saturation sensors 42 of the same type as fluid sensors 22 activate exciter circuit response. The circuit for energizing the exciter is the power bus wire system including wires 47 and 48.

FIG. 10C illustrates yet another possibile target configuration. A zener diode 21 has been added between fluid sensors 22 and switching relay 24. This makes the target sensitive to heavy drenching of fluid so that target apparatus will not respond when lightly penetrated by fluid. A resistor or comparable opponent can be used in place of the zener diode to achieve a similar desensitizing effect.

OPERATION OF EFSATA

In the figures, electrodes 22 are mounted in a special electrode housing 50 to accommodate the addition of the saturation chamber 40, explained later. Electrodes 22 may be distributed about any suitable sheathing or housing for exposure, as shown on housing 50. Electrodes 22 are made of any metal that conducts electricity, and are distributed in groups of two about the face of the housing 50.

In FIG. 10A, bus wire 52 connects each left electrode about the face of sensor array housing 50. Bus wire 52 also connects to one input of relay 24 and additionally connects to left sensor 42 in saturation chamber 40. Bus wire 54 connects to each right sensor 22 about the sensor array housing 50, thus connecting to right sensor 42 contained in top of saturation chamber 40. Bus wire 54 additionally connects to positive of power supply 44 via connecting harness 43 and bus wire 47. A conventional power source 44 biases input of relay circuit 24 via bus wires 52 and 48. Power switch 49 turns the unit on and off. When activated power switch 49 offers operating bias to timer chip 32, counting chips 34, 36 and light emitting diodes 38 via bus wire 47. Bus wire 54 extends from each right sensor on sensor target housing 50, routes to connect to positive of power source 44 through fluid release cap 45 and via connecting harness 43.

Connecting harness 43 is assembled into fluid release cap. If cap is removed, power source is isolated from sensors 22, demobilizing target. This arrangement is provided using the addition of saturation chamber 40 for added response and added interaction dimensions explained later.

As the focal point of target apparatus 18*a*, fluid sensor electrodes 22 and relay 24 are the essence of the operation. One input of switching relay 24 connects to negative of power source 44 via bus wire 48. Positive of power source 44 may be directed to remaining input of relay 24 via bus wires 54 and 52. A short circuit across electrodes 22 directs positive of power supply 44 to activate switching relay 24. Sensors 22 and relay 24 become the key mechanisms in operation of the EFSATA. The detector electrodes initiate an order and the relay completes it by connecting the signal device load to power.

When liquid penetrates any set of two electrodes 22 in the sensor array zone, a short detector circuit is created. This short circuit allows positive of power source 44 to be electrically connected to energize relay 24 via bus wires 54 and 52. Relay 24 is connected to actuate signaling or scoring devices. Each exciter device 26, 28, 30, 32, 34, 36, 38 connects appropriate lead to electrical ground. Positive operating bias is supplied via bus wire 47. Triggering signal is supplied from power supply 44 to exciter devices via output of solid state relay 24 via bus wire 56. Positive bias bus wire 47 connects to one output of relay 24. Relay 24 output supplies positive triggering signal via bus wire 56 to exciter device 26, common noise generating chip and to typical timer chip 32. The noise generating chip 26, when triggered by relay 24 due to short circuit of electrodes 22, actuates speaker 28 with noise and flashes lights 30. While triggered via relay 24 and bus wire 56, common timer chip 32 advances counting sequence via counting circuitry chips 34, 36 and 38. Operating bias for counting circuitry is supplied via bus wire 47. Reset switch 58 resets timer and may be located at any convenient area on the chosen embodiment gear.

With this arrangement noise can be generated by speaker 28, while lights 30 flash simultaneously and digital counter advances upon liquid penetration of sensors 22. The counting sequence tracks liquid penetration time experienced by short circuit of electrodes 22, creating an exciting and new kind of toy.

Figure 10B:
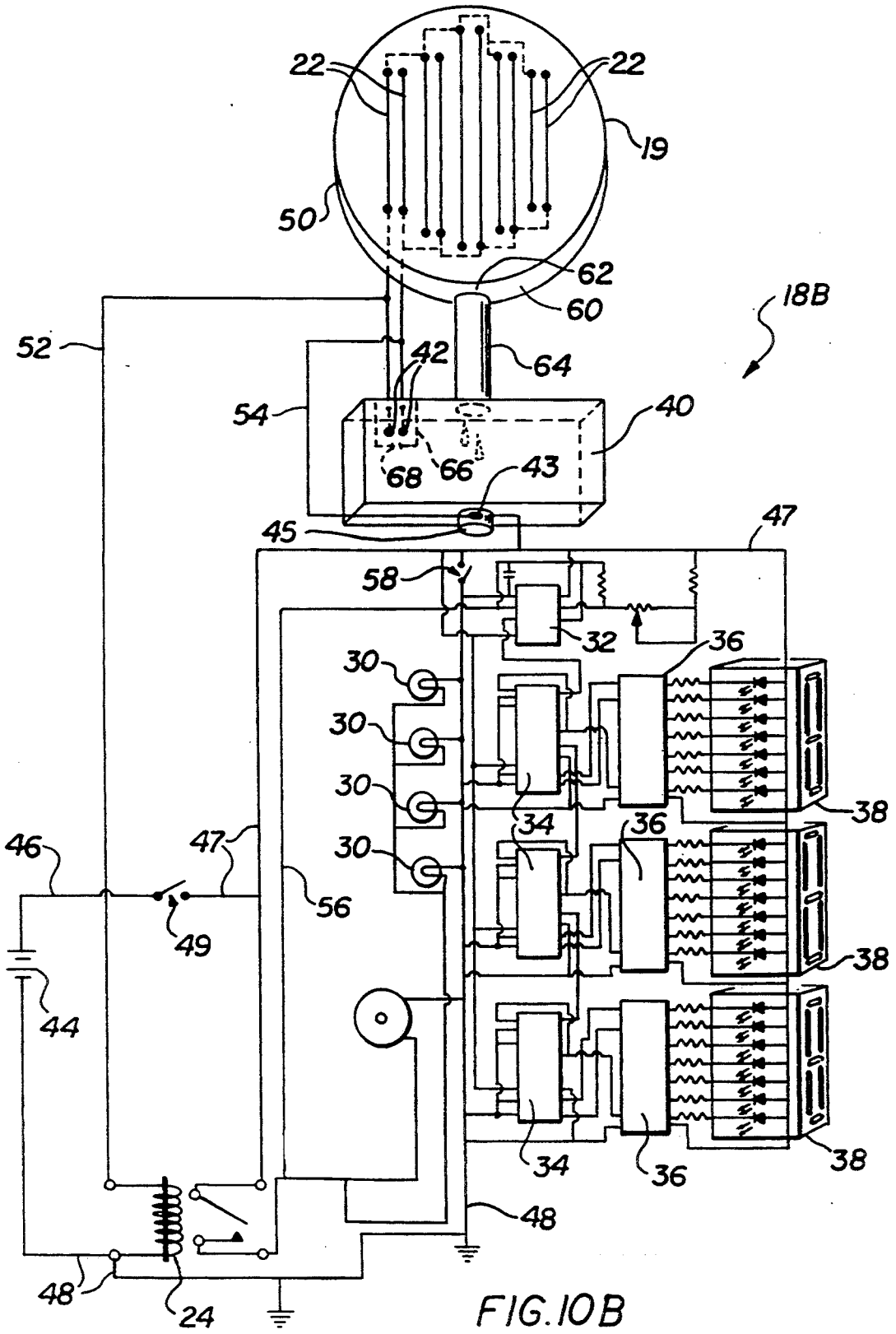
FIG. 10B depicts schematic representation of Electronic Fluid Sensing Actuating Target Apparatus utilizing another noise generating exciter circuit.
Figure 10C:
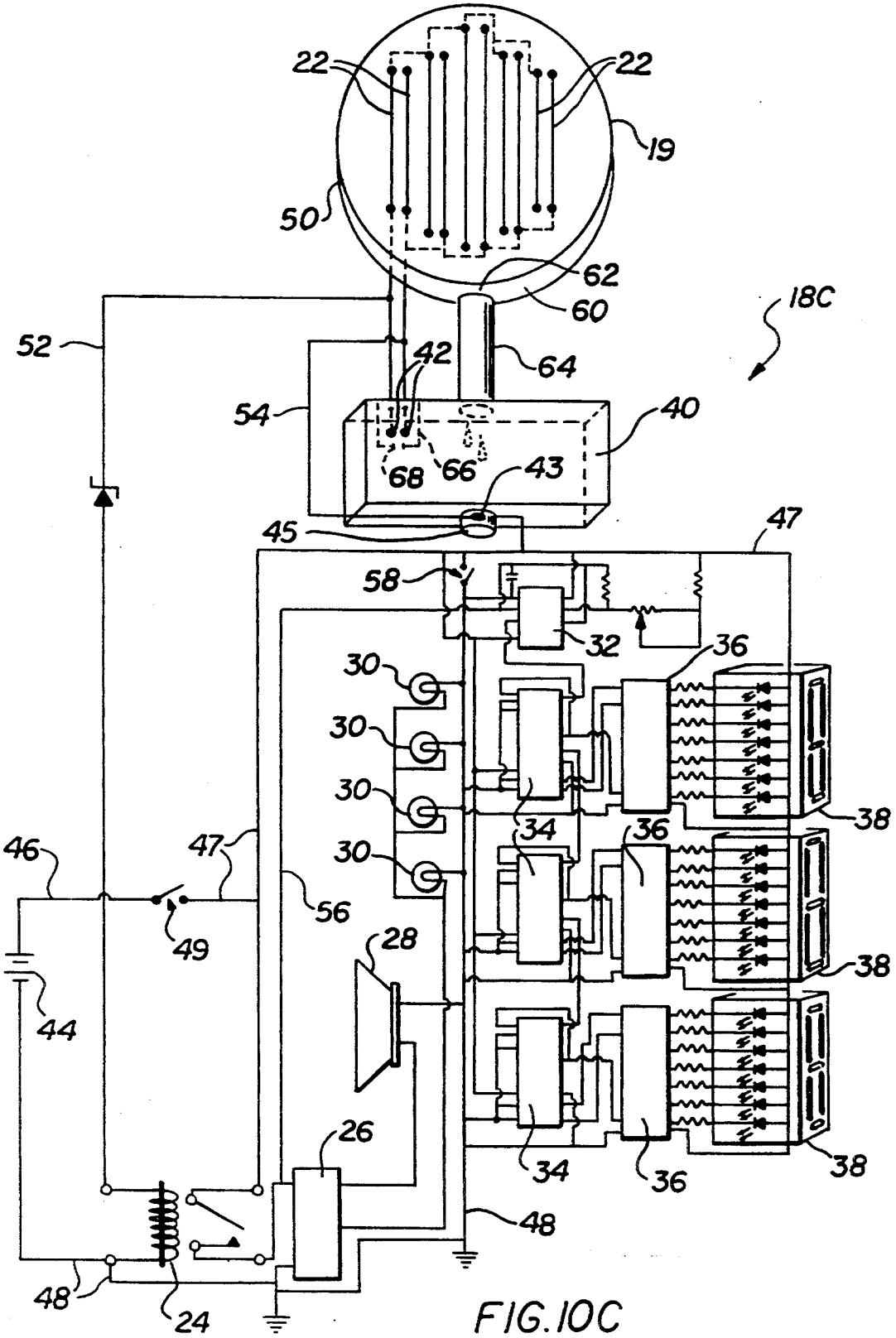
FIG. 10C shows schematic representation of Electronic Fluid Sensing Actuating Target Apparatus that is sensitive only to heavy drenching via placement of the zener diode between the fluid sensors and the switching relay.

As shown in FIG. 10B, optional exciter devices may be added to the apparatus to vary exciter responses. Exciter device 28 speaker in FIG. 10A could be replaced by a buzzer or other suitable noise generating component that allows for noise generating exciter response. In FIG. 10B, buzzer 25 and lamps 30 could then be driven directly from relay 24, instead of being driven by integrated chip 26 in FIG. 10A. Buzzer 25 and lamps 30 would be activated by relay 24 upon short circuit of fluid sensors 22 due to penetration of liquid to sensors 22 in FIG. 10B. To advance counter, timer circuit 32 for counting light emitting diodes 38 is triggered directly by trigger signal on output of relay 24. Trigger signal for timer 32 circuitry could be triggered by responses other than target sensor 22, such as saturation chamber sensors 40. Some of these applications are explained later.

FIGS. 10C and 10A operate the same, except the target configuration in 10C will only respond when it is heavily drenched by fluid. This is due to the zener diode 21 added between target fluid sensors 22 and relay input 24. The fluid sensors 22 become less sensitive to fluid due to the reverse bias created by the zener diode 21. Once the reverse bias of zener diode is overcome, a triggering signal activates switching relay 24 which actuates the exciter devices assembled therein.

FIGS. 12A and 12B show an alternate means for sensing of fluid. In FIG. 12A the addition of capacitive reactive sensing circuitry is shown. Metal fluid sensors 22 are utilized as in FIG. 10. However, instead of using resistive fluid sensing means, capacitive fluid sensing means is used to activate necessary switching means (24) for actuating exciter components of embodiment thereof.

FIG. 12B shows enlargement of schematic for capacitive reactive fluid sensing circuitry. Included is a basic signal generator integrated chip 27 and respective biasing resistors and capacitors thereof. Integrated chip 29 is a common amplifier. Integrated chip 31 is an ordinary RMS to DC converter. Resistors 33A, 33B, 33C, 33D and capacitors 35A, 35B, 35C create a capacitive network for generating a reference frequency upon input from signal generator integrated chip 27. Fluid sensors represented by 78 and 79 denote each right or left electrode in the fluid sensor array. The circuit of elements 78 and 79 parallels one of the four sides of the network. Sensor electrode 78 connects to one side of the capacitive network and to input of amplifier 29. Sensor electrode 78 serves as the reference point for detecting capacitive change upon the penetration of fluid to sensor array. Sensor electrode 79 acts as a capacitance change indicating input to the capacitive network comprised of capacitors 35A and 35C, and connects to an input of amplifier 29. The other input of the amplifier 29 is connected to the network corner opposite the element 79 connection to the amplifier. When the capacity change caused by the penetration of fluid fluctuates the frequency generated by signal generator 27 and capacitive network, amplifier 29 causes RMS to DC convertor 31 to generate an activating signal for a switching means. Thus exciter components 26, 28, 30, 32 34, 36, 38 are thereby actuated upon activation of the switching means.

Figure 13B:
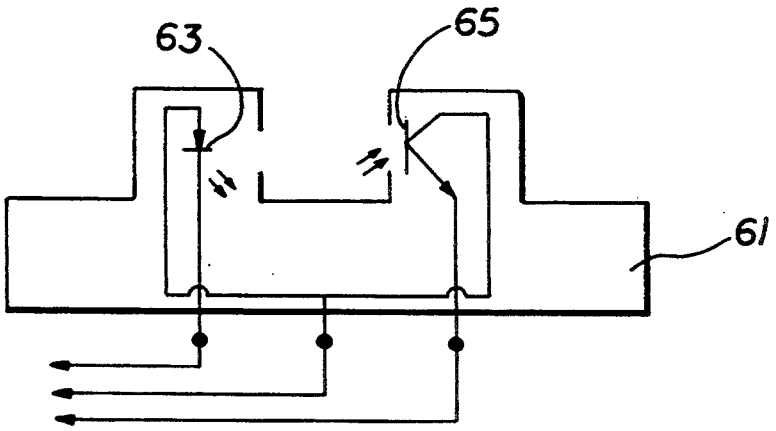
FIG. 13B illustrates schematic enlargement of optoelectronic fluid sensor.
Figure 13C:
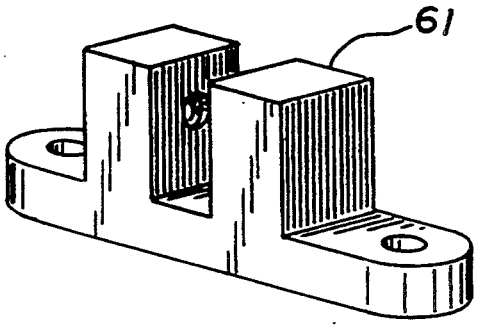
FIG. 13C illustrates enlargement of perspective view showing optoelectronic sensor.

FIGS. 13A, 13B and 13C show optoelectronic fluid sensing means. Optical sensors containing light emitting diodes 63 and phototransistor 65 are distributed about the face of target housing 50. Fluid sensor 61 is a collective term intended to designate the group of optoelectric sensors about the face of housing 50. Each sensor in the array is electrically connected in parallel as sensor 61, shown for simplification. When fluid penetrates slotted area of sensors 61, light path from LED 63 to phototransistor 65 is blocked, resulting in triggering signal for activating switching means 24, thereby actuating exciter components 26-38 assembled therein.

Signal from sensor 61 is normally high. To activate switching means 24, signal is connected to input of NOR Gate created by transistors 75 and 77 and respective biasing resistors. When penetration of fluid blocks light path to phototransistor 65, sensor 61 generates low signal. This is fed to effective NOR gate created by transistors 75 and 77 and respective biasing resistors. NOR Gate then sends high signal to solid state relay 24 or comparable means activating such switching means, thereby actuating exciter response circuitry 26–38 assembled into the embodiment thereof in FIG. 13A.

FIG. 14A shows EFSATA using mechanical fluid sensing means for activating switching means 24, thereby actuating exciter devices 26–38 of embodiment thereof. Metal pivoting electrodes 93 are placed on conducting bar 91 via suspending hole shown in side view of pivoting electrodes, FIG. 14B. Rubber standoff posts 95 secure conducting bar 91, which suspends pivoting electrodes 93. Weight bands 97 balance pivoting electrodes 93 to suspend in mid air. The force from penetration of fluid penetrating top of pivoting electrode 93 causes contact with conducting bus strip 99. Bus strip 99 may be any metal that conducts electricity.

Positive bias is supplied to pivoting electrodes 93 through conducting bar 91 and bus wire 54. Whereupon contact of pivoting electrode 93 to bus strip 99 provides actuating signal via bus wire 52 for switching means 24 solid state relay or comparable component, thereby actuating exciter components 26-38 assembled therein for the chosen embodiment.

Again, many possibilities exist for mechanically actuated direct current fluid sensor arrangements on the EFSATA. These and other fluid sensing means are suitable for the applications described here.

Figure 3A:
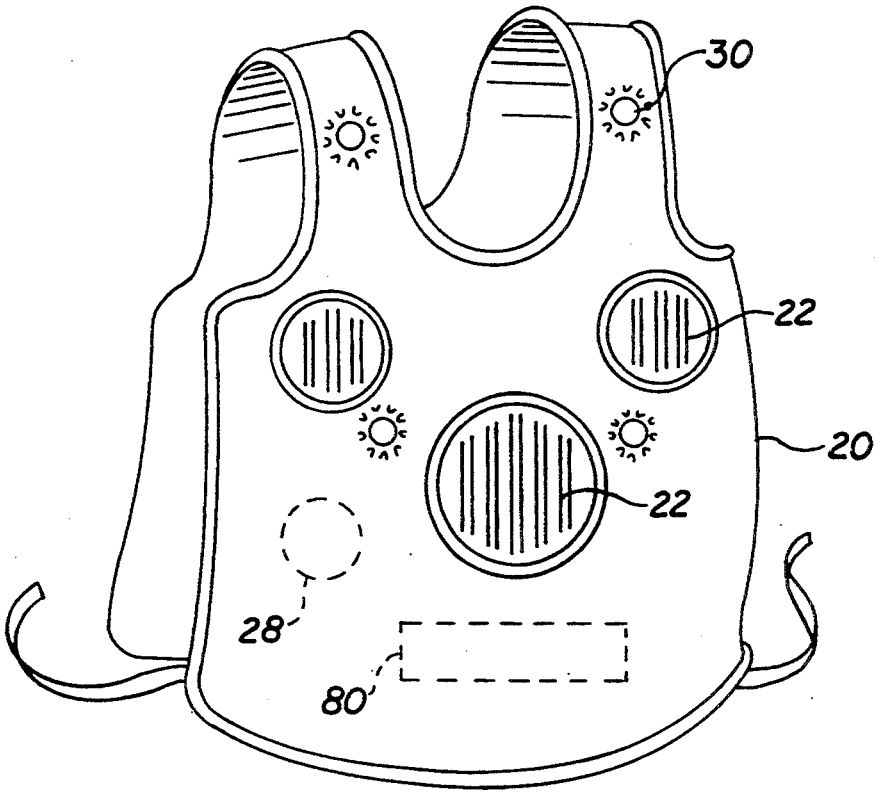
FIG. 3A and FIG. 3B are perspective views of other embodiments of my target apparatus incorporating a garment vest, FIG. 3A, showing a speaker 28, an electronic fluid sensing apparatus assembly 80 in hidden line position, and diodes 38, FIG. 3B showing water saturation chamber 40.
Figure 3B:
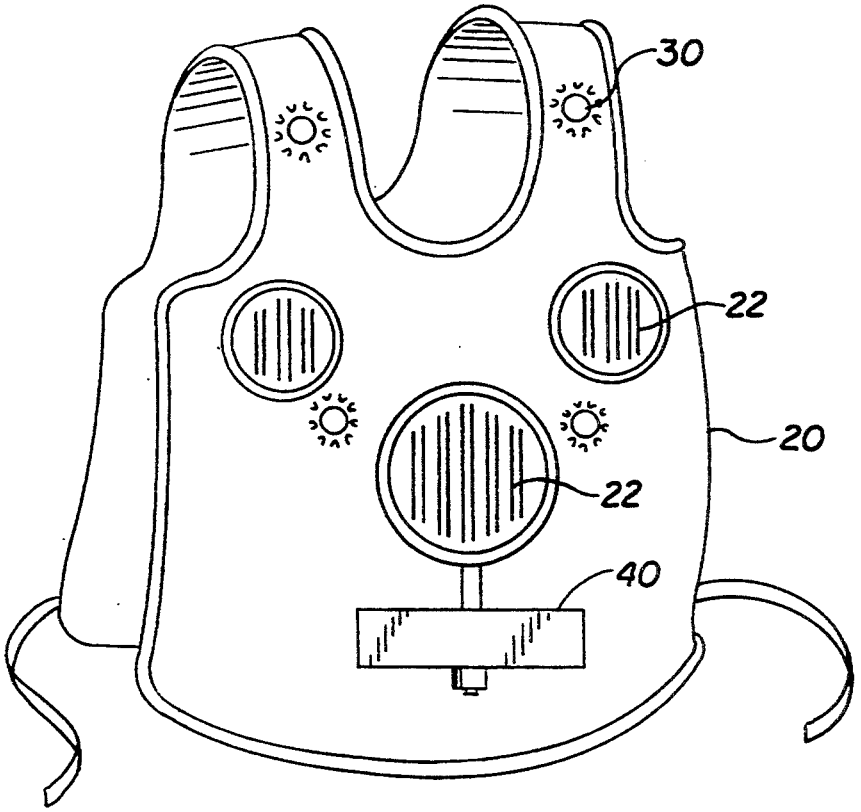
Figure 4:
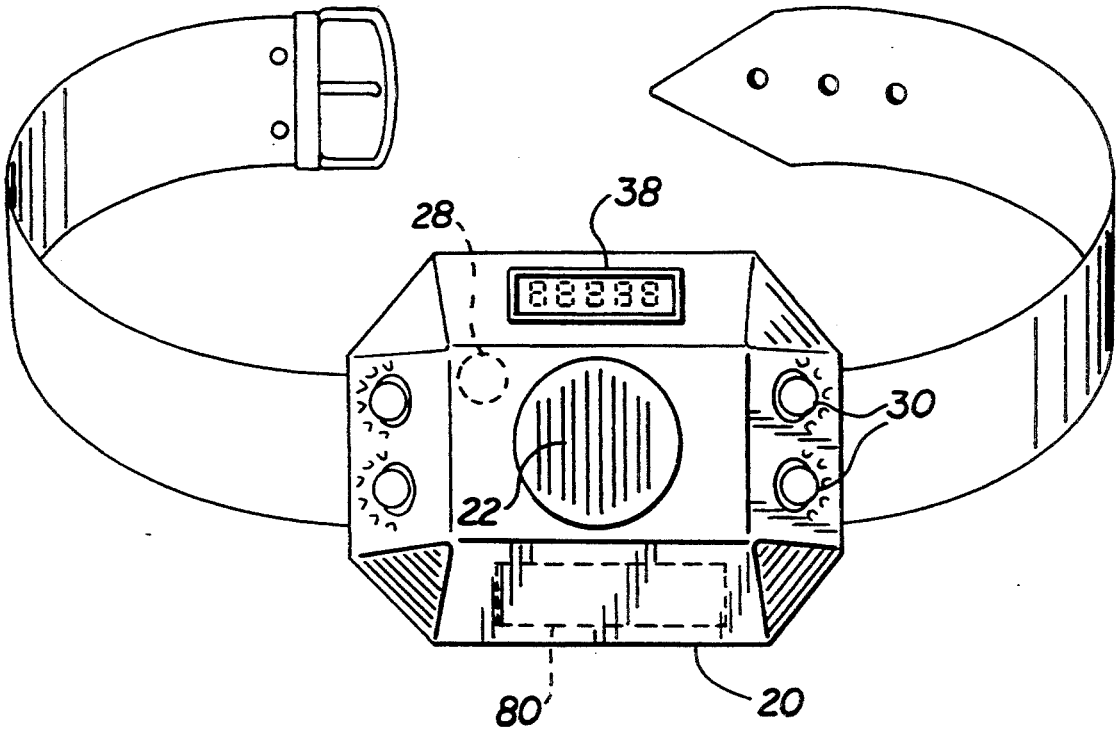
FIG. 4 shows the target apparatus including exciter (i.e. electrical signal) devices assembled into a belt.
Figure 5:
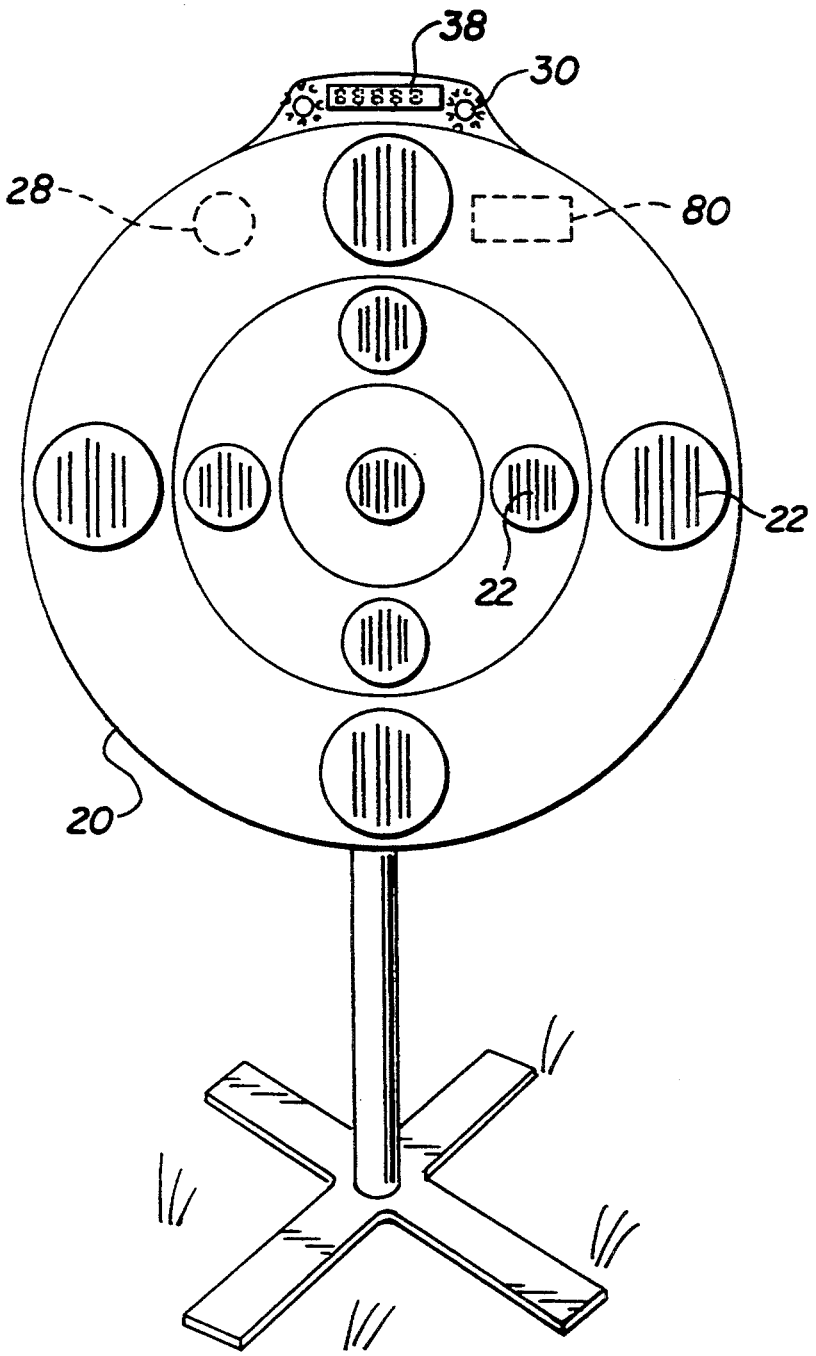
FIG. 5 illustrates the target apparatus including exciter (i.e. electrical signal) devices assembled into a stationary housing.

Shown in FIGS. 3A and 10A is the addition of a saturation chamber 40 that increases the range of cause and effect options by recognizing preset volume of fluid, thereby suggesting new and exciting realms of water toy play.

Sensor housing 50 provides a recessed lip 60 containing an aperture 62 for collection of liquid falling from target sensors 22. Liquid spilling onto aperture 62 is routed to saturation chamber 40 via liquid collection tube 64. Saturation sensors 42 are contained at top of saturation chamber 40. Sensors 42 are surrounded by splash cover 66 to avoid false triggering. Cover 66 provides hole 68 for entrance of liquid. Sensors 42 protrude through top of chamber 40, forming a waterproof seal. Once liquid saturates chamber 40, liquid seeps into splash cover hole 68, creating a short circuit between bus wires 54 and 52. This activates switching relay 24, constantly actuating exciter devices housed therein. To deactivate switching relay 24 after saturation of chamber 40, fluid release cap 45 must be removed to empty chamber 40 of liquid, ceasing short circuit between saturation sensors 42. Positive of power supply for biasing electrodes 42 and 22 is routed through fluid release cap 45 via a connecting harness 43 assembled into cap 45. This connecting harness allows bus wires 54 and 47 to plug into connector harness 43, assembled into release cap 45.

Once chamber 40 saturates, exciter devices remain constantly actuated. To cease exciter actuation, fluid must be emptied from saturation chamber 40, by removing fluid release cap 45. Target apparatus is demobilized when fluid release cap 45 is removed. Cap 45 may be retained by opponent, effectively demobilizing target apparatus. This feature allows for more interaction among adversaries and provides additional challenging game variations.

Figure 6:
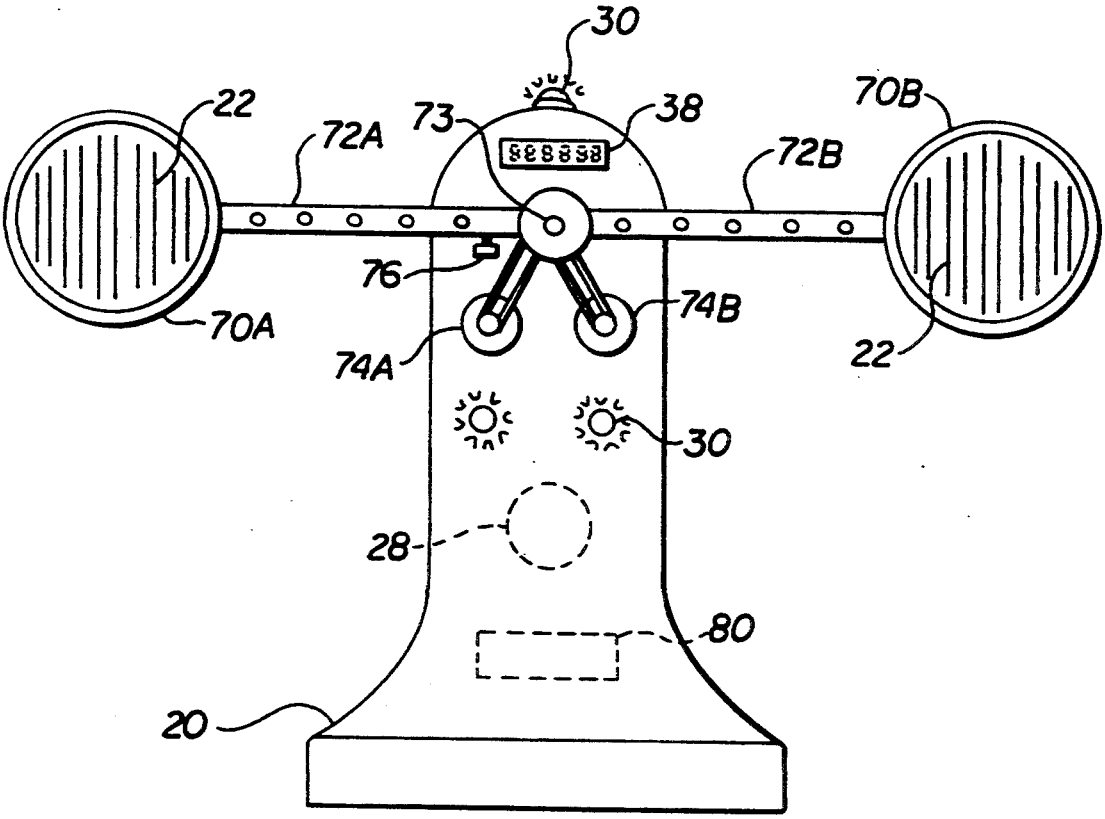
FIG. 6 depicts the target apparatus including exciter devices assembled into and controlling a moving target arrangement.
Figure 7:
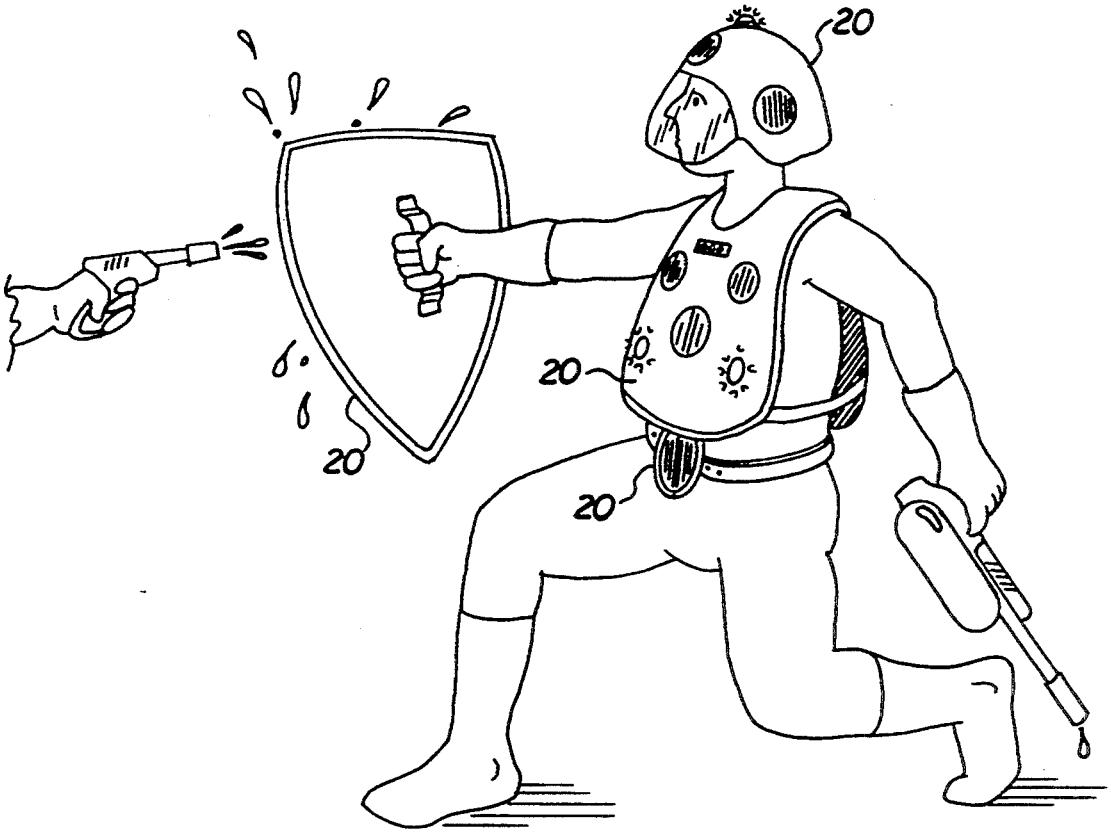
FIG. 7 illustrates a player who carries a shield type target apparatus and wears a garment target apparatus, both in accordance with the invention.

Another type of target configuration is shown in FIG. 6. This combination contains two separate sensor array housings 70A and 70B. The schematic representation of the target is shown in FIG. 11. With this target configuration, sensor array housings are suspended upon actuation bars 72A and 72B, extending from a central common axle 73. The suspension of sensor array housings 70A and 70B on actuation bars connected to common axle 73 causes the assembly to seek balance. If balance occurs, microswitch 76 is physically contacted by actuation bars 72A and 72B, thereby turning on microswitch 76, which actuates exciter devices 26–38.

The bars 72A and 72B travel in a circular direction according to the drive motor engaged, 74A or 74B. Drive motor is engaged upon penetration of liquid on sensors 22 of either sensor array 70A or sensor array 70B. When liquid penetrates sensors 22 on array 70A, actuation bars and assembly move in one direction. To reverse direction, liquid must be directed to opposite sensor array 70B and penetrate sensors 22 contained therein. Motor 74A rotates the assembly in a clockwise manner and motor 74B rotates the assembly in a counter clockwise manner. Relatively, sensor array 70A rotates assembly in clockwise direction and sensor array housing 70B counter clockwise.

Exciter microswitch 76 is located at 9 o'clock within the perimeter of actuation bars 72A and 72B. This microswitch provides triggering signal for exciter components 26–38. These include noise making, digital counting, and lighting circuitry similar to exciter devices discussed earlier.

When the unit is activated, liquid penetrating electrodes 22 upon either sensor array causes a short circuit, activating the relay 71A or 71B respectively, causing drive motor to turn. Should assembly turn such that actuating bars 72A or 72B physically contact microswitch 76, exciter devices 26–38 will be actuated. Simultaneously, counter will advance counting sequence. Directing liquid to opposite sensor array will reverse target and may relieve actuating bar 72A or 72B from microswitch 76. Action may be repeated to stop actuating bars 72A or 72B from physically contacting microswitch 76. The less microswitch 76 is turned on, the lower the number on counter circuit 38 light-emitting diodes will be. This is but one electromechanical configuration. Possibilities for electromechanical, moving or rotating devices are endless.

What is claimed and desired to be secured by letters of patents of the United States is:

1. In a fluid-jet game, a target apparatus comprising in combination:

A target support adapted to be worn as a garment by a player;

an electrical fluid presence detector carried by said support and positioned to constitute the target bull's-eye, said detector giving an order in response to a target hit by the fluid-jet; and electrical signaling means responsive to said order to indicate a hit.

2. In a fluid-jet game, a target apparatus in accordance with claim 1 in which the detector includes:

An electrical impedance, and in which said order is initiated by an impedance change caused by the presence of fluid.

3. In a fluid-jet game, a target apparatus in accordance with claim 2 in which the impedance comprises closely spaced electrical conductors constituting an electrical resistance parameter.

4. In a fluid-jet game, a target game apparatus in accordance with claim 1 in which the target apparatus further includes:

A control relay having an input coupled to the detector and; also an output; and a bus wire power system connected to said output, said signal means being connected to and energized from said output.

5. In a fluid-jet game, a target apparatus in accordance with claim 4 together with:

Means for promptly disposing of fluid in the detector, such means comprising; an insulating grill adjacent the spaced conductors, and an absorber adjacent the grill.

6. A game comprising the combination of: A water-jet source to be operated by a shooting player;

and target apparatus, comprising:

A target support having a target zone and formed as a garment to be worn by a target player;

an electrical moisture detector carried by said support and placed to constitute the bull's-eye of the target; and an electrical signal means responsive to a signal from said detector to indicate a hit on the target by the water-jet.

7. In a water-jet target game, the combination of:

A garment to be worn by a player as a target;

A detector secured to said garment and positioned to provide a bull's-eye thereon;

an electrical signaling means controlled by said detector and secured to said garment for providing an indication of a hit on the bull's-eye; and a counter means controlled by said detector and secured to said garment for counting a score of hits.

8. An electronic hit sensing target apparatus for use in a fluid jet-stream target game comprising, in combination;

a support providing a target zone;

a power source carried by said support;

a fluid presence detector, positioned as the bull's-eye of said zone, for providing an electrical response to a hit by the fluid on the bull's-eye;

said detector comprising spaced conductors short-circuited by penetration of fluid therebetween so that said response is an electrical order;

electrical signaling means responsive to said order for indicating a hit;

an insulating screen adjacent the conductors for leading penetrating fluid away; and a fluid absorber adjacent said screen for preventing false triggering and readying the conductors for a repeat response to a suceeding hit.

9. A mobile target apparatus comprising; A support having a target zone and adapted to be worn by a player;

an electrical fluid-presence detector carried by said support and positioned to provide a target bull's-eye, said detector producing an electrical control effect when hit by a fluid-jet stream; and an electric signal means responsive to said control effect to indicate the hit.

10. A target apparatus in accordance with claim 9 in which the control effect is a change in capacitance included in the detector.

11. A target apparatus in accordance with claim 9 in which the control effect is the output of water sensing optoelectronic elements included in the detector.

12. A target apparatus in accordance with claim 9 in which the detector includes a control relay.

13. A target apparatus comprising:

A support, first and second electrical water-presence detectors each carried by the support and each having a pair of spaced conductors constituting resistance parameters;

a water storage tank for accumulating water from the first detector;

relay means actuated by either detector and coupled to both for setting up a two wire power system; and a signal device activated by said system, the first detector sensing, by a resistance drop, a hit on the target, thereby closing the relay, the signal device simultaneously initiating an instantaneous signal, the second detector being positioned in the tank and sensing, by a resistance drop, a predetermined water level therein, thereby to close and hold the relay closed and the signal continuous.

14. The combination in accordance with claim 13 in which one of the wires of the two wire system is segmented by an open or close switch, and further comprising a discharge plug for the tank, the switch being arranged to open when the plug is removed from the tank, whereby the sensor system is disabled when the tank emptied.

15. A target apparatus comprising:

a support having a target zone;

an electrical fluid-presence detector carried by said support, said detector having electrical sensing elements positioned in static mode and exposed in said target zone to provide a bull's-eye, said detector producing an electrical control effect when said exposed electrical sensing elements are directly hit by a fluid jet stretch and an electric signal means responsive to said control effect to indicate a hit.

* * * * *

UNITED STATES PATENT AND TRADEMARK OFFICE

CERTIFICATE OF CORRECTION

PATENT NO. : 5,411,269

DATED : May 5, 1995

INVENTOR(S) : Keith Thomas

It is certified that error appears in the above-indentified patent and that said Letters Patent is hereby corrected as shown below:

Column 6, lines 41 and 47, also column 7, line 12, "fight" should be "right".
In the claims :
Claim 14, Column 14 Line 53, "tank emptied" should be "tank is emptied" .
Claim 15, Column 14, line 62, "stretch" should be corrected to "stream" .

Signed and Sealed this

Fifteenth Day of April, 1997

Bruce Lehman

*Attest:*

BRUCE LEHMAN

*Attesting Officer*

*Commissioner of Patents and Trademarks*